United States Patent [19]

Wilensky

[11] Patent Number: 4,551,979

[45] Date of Patent: Nov. 12, 1985

[54] METHOD AND APPARATUS FOR A THERMODYNAMIC CYCLE BY USE OF DISTILLATION

[75] Inventor: Joseph Wilensky, Denver, Colo.

[73] Assignees: Soma Kurtis; Jack C. Sloan, both of Denver, Colo.

[21] Appl. No.: 506,707

[22] Filed: Jun. 20, 1983

Related U.S. Application Data

[62] Division of Ser. No. 262,783, May 11, 1981, Pat. No. 4,442,675.

[51] Int. Cl.[4] ..... F01K 17/00; F01K 25/06

[52] U.S. Cl. ..... 60/648; 60/649; 60/673; 203/DIG. 20

[58] Field of Search ..... 60/648, 649, 673; 202/182; 203/DIG. 14, DIG. 20

[56] References Cited

U.S. PATENT DOCUMENTS 4,288,989 9/1981 Cassidy ..... 60/685

4,333,313 6/1982 Cardone et al. ..... 60/649

*Primary Examiner*—Stephen F. Husar

*Attorney, Agent, or Firm*—Jack C. Sloan

[57] ABSTRACT

A working fluid in the gaseous state at some initial temperature and pressure is expanded polytropically to a resulting exhaust fluid having some lower temperature and pressure in order to produce useful work. Large quantities of a motive liquid are then employed as the vehicle for approximating an isenthalpic compression of the working fluid. The preferred method for effecting this recompression is to reduce both fluids to a single liquid phase which is then energized. Thereafter the two fluids can be reconstituted to their initial states to complete the thermodynamic cycle which, depending upon the fluids selected, can be located in a broad range of the temperature spectrum.

76 Claims, 2 Drawing Figures

METHOD AND APPARATUS FOR A THERMODYNAMIC CYCLE BY USE OF DISTILLATION

This patent application is a divisional application of my copending application entitled "Method for Thermodynamic Cycle" filed May 11, 1981 having Ser. No. 262,783 now U.S. Pat. No. 4,442,675.

BACKGROUND OF THE INVENTION

1. Field of the Invention

This invention relates generally to obtaining useful work from the polytropic expansion of working fluids by reversible adiabatic expansion. More particularly it is concerned with a method of restoring such working fluids to their original thermodynamic conditions by means of an approximate isenthalpic compression, followed by heating, preferably by the use of ambient heat sources.

2. Description of the Prior Art

Useful work production by heating and vaporization of liquids, including cryogenic liquids under pressure, and thereafter expansion to exhaust vapors is well known. Most current techniques, however, particularly those designed to employ ambient heat sources, assume a continuous supply of working fluid from outside sources and are not concerned with recompressing and condensing exhaust vapors back to the liquid state in order to achieve a "closed" thermodynamic cycle.

SUMMARY OF THE INVENTION

An understanding of this invention is best achieved by first discussing certain theoretical considerations of the laws of thermodynamics and thereafter relating these considerations to the invention by means of thermodynamic charts, diagrams, and supporting mathematical equations. Finally, exemplary physical embodiments of the invention will be placed in a working environment to demonstrate how useful results can be obtained.

The theoretical discussion must start with the realization that in all attempts to obtain work from heat the concept of force is indispensible. For such processes to be continuous, an assumed inexhaustible source of force can only be replaced by a source of force which when exhausted can be replenished. Within the confines of this disclosure the above statement implies the circulation of a working fluid at high temperature and pressure, giving up work energy and exhausting to low temperature and pressure. The working fluid must then be reenergized by repressuring and reheating it to its original state in order to complete the cycle. If all of these steps were to take place perfectly, the relationship of heat to work conversion would become independent of path, devices, purposes and depend only on the thermodynamic states of the working fluid. The invariable result of any such energy cycle, if carried out perfectly, would be that only the heat removed from the total heat in the course of the expansion would be converted to work. If additional heat were removed, both heats would have to be replaced to reconstitute the total heat. This concept yields the following well-known relationship (using the thermodynamic temperature scale):

$$\frac{W}{Q} = \frac{T_1 - T_2}{T_1} \qquad \text{EQUATION 1}$$

where:

W=Net work output

Q=Gross heat input $T_1$=Thermodynamic absolute temperature attained after gross heat input $T_2$=Thermodynamic absolute temperature attained after heat output This relationship of heat to work is often referred to as the Carnot Limitation and $T_2$ has often been called the "sink temperature" and described as point of limitless heat disposal, so large as to be essentially unaffected by such heat disposal. This conclusion is reached in view of the cycle as described in Equation 1 being forced to discard heat at temperature $T_2$. That it must discard heat at a permanent, unaffected lower temperature has set an impassable limitation, preventing the re-use of the heat thus discarded. Heretofore, the repressuring of the working fluid without the total expenditure of work output has only been accomplished at the irrevocable sacrifice of the latent heat of vaporization.

This invention has many aspects and applications but its most important and fundamental teaching is that the need for a "heat sink" as the necessary interpretation of the lower temperature in the relationship:

$$W/q=(T_1-T_2)/T_1$$

is not invariably true, nor is its interpretation as a limitation. Even though it remains true that in the course of a single trip through a thermodynamic cycle, the total heat encompassed by the working fluid between the temperature extremes may produce only the net work available in Equation 1, it is not necessarily true that the residual heat must be lost or discarded irrevocably. Through isenthalpic compression it may be maintained as a heat inventory to be recycled, implemented by additional heat, and re-used as a vehicle by which an added portion of heat may be sequestered and employed to produce useful work at a high degree of efficiency.

The vehicle for accomplishing this is a large quantity of motive liquid which absorbs the residual heat of the working fluid and restores it at a pressure which then becomes available for the production of useful work. Hence, the process of deriving work from heat is no longer moored to a local ambient temperature as a heat sink. This permits the work derivation to be conducted at any point of convenience in the temperature spectrum. Consequently, Equation 1 may now be contemplated in its true perspective: W/Q, the conversion ratio of work to heat in a single pass of a working fluid through a thermodynamic cycle, approaches unity either as the higher temperature gets very high or as the lower temperature gets very low.

The above theoretical considerations can be clarified if they are also related to a thermodynamic chart such as the one depicted in FIG. 1 wherein the thermodynamic variable, temperature T, in degrees Rankine, is presented as the linear ordinate and the thermodynamic variable, entropy S, in BTU/lb.-degree Rankine, as the linear abscissa. Isobars connect paired values of the coordinates at equal pressure, P, in pounds per square inch absolute. Isenthalpic lines connect paired values of the coordinates at equal values of the heat content, H, in BTU/lb. A heavier, dome-shaped, curved line ("phase envelope" or "vapor-liquid phase envelope") depicts the boundary condition of vapor-liquid equilibrium wherein the vapor and liquid phases of a chemical species in the absence of other species may exist simultaneously and contiguously. Paired values of the coordinates enclosed below this boundary represent the values of the coordinates for the algebraic combination of the properties of the liquid and vapor at the phase envelope in their existing proportions.

It is of particular importance to note here the effect of the presence of more than one chemical species on the interpretation of the parameters and variables of this chart. Those skilled in the art will recognize that for each additional species present, one additional degree of freedom is made available. The consequences of this are that, although horizontal lines within the envelope still connect points of equal temperature and pressure, they do not, in general, connect points of equal composition, i.e., mass fractions of the chemical species, in the two different phases represented in this region. It is intended in this invention to derive important benefits from this inequality.

The highest point, CP, of the phase envelope is termed the "critical point", the value of the ordinate at this point the "critical temperature", and the value of the pressure along the isobar through this point (and tangent to the envelope at this point) the critical pressure.

At all points on the chart at temperatures greater than the critical temperature the fluid is entirely in the gaseous state and noncondensible by any means unless cooled below that temperature. The region below this temperature enclosed by the axes and the left side of the phase envelope is entirely liquid. In the body of this region vapor may be created by combinations of finite changes of temperature and pressure and is termed "sub-cooled". At the phase envelope boundary, the liquid is termed "saturated" and any increase in temperature or decrease in pressure will be accompanied by some evaporation. The region below the critical temperature and to the right of the phase envelope consists entirely of vapor. In the body of this region finite amounts of reduction in temperature and/or increase in pressure may accomplish some condensation. The vapor in this region is termed "superheated". At the right phase envelope boundary, the vapor is termed "saturated" such that any decrease in temperature or increase in pressure will be accompanied by some condensation.

Within the phase envelope itself there is a conceptualized region of mixed vapor and liquid phases. Here, isobars are horizontal, i.e., parallel to the abscissa, and connect points on the envelope of identical temperature and pressure which are termed "saturation temperature" and "saturation pressure" or "vapor-liquid equilibrium temperature and pressure". Quality, defined as the mass fraction of vapor in the mixed-phase region, for any of the thermodynamic functions within the vapor-liquid envelope, may be entirely ascertained by linear algebraic interpolation of the values for the function of the pure phases at saturation.

Thus, such a temperature vs. entropy chart conveniently describes the thermodynamic states through which the cycle of this invention passes. To this end, a description of three states (also called "conditions" or "points") is essential. State A represents the point of highest pressure, $P_1$, and temperature, $T_1$, of the working fluid. State B represents the point of lowest pressure, $P_2$, and temperature, $T_2$. State B could initially fall within the vapor-liquid phase envelope as shown in FIG. 1, or initially fall outside the envelope and thereafter be forced into the envelope by various methods hereinafter discussed. In any event, the working fluid in State B is usually referred to as the exhaust vapor (it is also called the "exhaust fluid" or the "low-pressure working fluid"). State C represents the system nominal high pressure, $P_3$, at an intermediate temperature, $T_3$. As in the case of state B, state C could also lie without the phase envelope or lie within it to the left of the saturated vapor line as shown in FIG. 1. Any given state B is connected to any given state C by a line of constant enthalpy. Other points X, J, CP, B′, and C′ are also located for clarification of certain theoretical considerations of this invention hereinafter discussed.

For example, one such theoretical consideration is that state B may be anywhere on the chart where the working fluid is at least partially vaporized and its temperature is lower than the critical temperature. It should be noted that throughout this patent disclosure, state B is conceptualized to include state B′ which is at the same pressure but higher enthalpy than state B. Similarly, state C is conceptualized to include state C′ which is at the same pressure but different enthalpy than state C. State C lies on the same line of constant enthalpy but at higher pressure than state B′. The path from B′ to C′ represents the path realized in an isenthalpic compression to the pressure of C from B′, the actual enthalpy change from B′ to C′ reflecting the additional work needed to overcome mechanical imperfections, overcome the natural tendency of the fluid to expand, and any net removal of heat from the working fluid. Point X for the purposes of this disclosure is a state along the saturated liquid boundary of the phase envelope. The specific location as shown in FIG. 1 is that of the state of saturated liquid at the temperature and pressure of state B. Those skilled in the art will appreciate that the path from point B′ to point C is accompanied by an equal change in energy to that which would be undergone by following the composite path from point B′ to point X and thence from point X to point C. Therefore, since B′ and C are at equal enthalpy, for every drop of liquid condensed from exhaust fluid vapor the latent heat of vaporization of that amount of condensate in going from point B′ to point X will be identically equal to the heat replacement required to restore that condensate from point X to point C. Furthermore, the characteristics of any working fluid are such that at successively lower exhaust fluid pressures, point C′ tends to depart progressively from point C. The coincidence of point C′ with point A would, in effect, cancel the advantages of the thermodynamic work cycle of this invention.

As indicated by current practice the technologies for effecting the transition along the thermodynamic paths from state A to state B and from state C to state A are well known. Methods and apparatus employed to produce the transition of the working fluid from state B to state C constitute the fundamental aspects of this invention. Nonetheless, the A to B and C to A paths have important interrelationships with this invention which should be clarified. Starting at state A we have a working fluid at system high pressure and at whatever temperature that can be provided. This working fluid can expand in any manner from entirely free, unopposed liberation to closely restricted, almost shutoff resistance to that expansion such that only a differential tendency to expand exists. The former, "free" expansion not being called upon to overcome resistance retains virtually its entire energy content and is thus, by definition, isenthalpic. It is termed "irreversible", represents essentially horizontal movement to the right of a point such as point A, and loses temperature only to the extent of the pressure-volume loss of the working fluid.

This phenomenon is known as Joule-Thompson expansion and can, in actuality, result in a rise in temperature if the change in the actual pressure-volume product is a gain. There is a point of reversal of this tendency that can be identified with any energy level of a working fluid. This is known as the Joule-Thompson inversion point which has been shown in FIG. 1 as point J for the specific line of constant enthalpy traversed in this isenthalpic compression.

On the other hand, almost equal opposition requires the expanding gas to do considerable quantities of work to overcome the opposition. This work is obtained at the expense of internal energy and/or the pressure-volume potential. A drop in pressure due to the inhibited expansion will in this case be accompanied by a large temperature decrease. For a truly differential pressure gradient, this energy transfer yields the maximum work output of the thermodynamic transformation. Using only internal heat, a maximum is converted to work in a process labeled "reversible adiabatic" and characterized by no change in the property called "entropy" and thus is called isentropic. Naturally, practical considerations such as thermal inefficiency, friction, etc., preclude perfect reversibility. Perfect isentropic expansion would be depicted on the chart by a vertical movement from point A to point B. In reality, at the thermal efficiencies achieved, the path from A to B′ is followed and slightly less useful work output is realized at the higher enthalpy of point B′. This practical approach to isentropic expansion is often referred to as "polytropic" expansion.

This invention contemplates the employment of any and all expansion devices known to the art that suit the stages of expansion along this path from A to B′. Expansion through a turbine to produce shaft work is the most common example. This invention also contemplates the provision of expansion engines that cause the path from point A to point B′ to enter the vapor-liquid phase envelope progressively, avoiding the shock and vibration caused by the abrupt, in-flow contraction accompanying condensation in turbine channels. Care should be taken, however, to prevent point B from ever entering any region where any portion of the working fluid might be solidified. That is to say, the state conditions should never be permitted to go below the triple point of the working fluid.

It should also be pointed out that the cryogenic methods known as Joule-Thompson free expansion processes or Joule-Thompson engine expansion processes can be utilized to force the working fluid into the vapor-liquid phase envelope and/or along the path from point B to point C since they are capable of producing extremes of low temperature, limited only by insulation efficiency. Thus, for purposes of initial start-up, control, fluid replenishment and/or deliberate discarding of heat from either the motive fluid or the working fluid, use of such Joule-Thompson expansion systems may prove advantageous in the practical practice of this invention.

A beginning appreciation of the thermodynamic, mechanical and hence, economic advantages of this invention can best be gained by comparing the B to A return path alternatives. If one were to recompress directly the working fluid, he would essentially return along the same vertical path (i.e., from point B to point A) since the fluid in itself would require the restoration of all the work it had yielded in the isentropic expansion. If the path from point B to point X and then from point X to point A were followed the latent heat of vaporization would have to be discarded in reaching point X. Alternatively, this invention contemplates the introduction of a "shortcut" to provide as much as possible for the exhaust fluid to be liquefied to an incompressible state, but in any case to restore pressure to the working fluid without the temperature rise of polytropic compression. This is possible since raising the pressure of any incompressible liquid can be accomplished without doing work. Also, by limiting the temperature rise the work required for repressuring the working fluid is substantially reduced.

If the working fluid at state B were noncondensible it would be possible to envision a "free recompression" by constant cooling of the fluid by maintenance of constant temperature in the fluid during compression. As in Joule-Thompson expansion, the fluid would experience little rise in enthalpy. For a condensible fluid, however, a rise in pressure will be accompanied by condensation and the accompanying release of latent heat of vaporization will result in a temperature rise. Thus the analogue to the isothermal compression of a noncondensible gas is the isenthalpic compression of a condensible gas. This, in a sense, is the compression counterpart of irreversible or "free" expansion.

Practicalities demand, however, that some work be done to move the fluid, to overcome friction, etc., so there are always departures from true constant enthalpy. Their presence is acknowledged in this patent application by use of expressions such as "approximating an isenthalpic compression."

Furthermore, it may be of great practical advantage to depart purposely from true constant enthalpy by deliberately discarding heat from the system to realize operation at selected states A, B, and C for given working fluids and motive liquids.

Although there are other devices for approximating an isenthalpic compression, this invention prefers the use of a specific method (or "apparatus") hereinafter referred to as isenthalpic compression (or an "isenthalpic compressor") for forcing an isenthalpic compression of the working fluid from a state B to a state C.

This preferred method energizes the working fluid by communicating and mixing a large quantity of a circulating incompressible motive liquid of selected composition (also referred to as the "motive fluid" or "motive liquid") with the working fluid to be recompressed. This quantity and composition may be obtained from a variety of sources such as an external feed stream, recycle of an fixed internal or external inventory, condensation of excess working fluid, etc. During the completion of energizing by the pumping which follows, the motive liquid serves as a solvent to contain the working fluid within itself as a single liquid phase, preventing vaporization and/or superheating of the working fluid, and preserving the working fluid and motive fluid at equal temperatures and pressures. That is to say the motive fluid as a selected, higher boiling solvent for the working fluid serves, in the large quantity provided, to reduce the partial pressure of the working fluid to a level such that the vapor pressure of the combined liquid is less than the total pressure of its surroundings.

The motive fluid performs these functions as it cycles between an energized and a de-energized state. In the context of this invention the expression "energizing" implies that portion of the total energy required to reconstitute the working fluid in state A, represented by the pressure increase required to reach state C. The energizing sequence of communicating, mixing, and pumping of the working and motive fluids in this method is governed by the presence of motive and working fluids of different composition. Thus, the communication and mixing of the fluids is accomplished in the course of the dissolution of the working fluid into the motive fluid. The resulting single liquid phase is then pumped, the motive fluid having served as a solvent vehicle for the working fluid.

This dissolution (communication and mixing) can be carried out by: (1) direct introduction and dissolution of the working fluid as a solute into the solvent motive liquid; (2) use of an absorber in which multi-stage contacting of the two fluids facilitates the total dissolution to a single phase, and (3) the incorporation of an eductor into the system to promote the dissolution, but without necessarily energizing either fluid. A commonplace example of the latter might be the use of a conventional water heater for boiler feed. Such a device could well be pressed into this service, providing communication and mixing of the fluids by the educting action of its high velocity jet nozzle.

In all cases, the resulting single liquid phase is then pumped to $P_3$ thereby achieving state C.

In these systems of chemical vapor-liquid equilibrium, further heating and contacting of the vapor and liquid phases result in the reconstitution of the composition and quantity of working fluid as an overhead vapor and the reconstitution of the composition and quantity of the motive liquid as a bottoms product liquid. The vapor is further heated to restore it fully to state A, and the motive liquid is cooled in order fully to reconstitute it in its initial state. The means for accomplishing this cooling may include the deliberate discarding of heat from the motive fluid or from the working fluid itself. Such a course of action might well be elected to implement the selection of states A, B, and C for prescribed chemical species.

The cooling of the motive fluid may be accomplished in devices known as heat exchangers thereby conserving within the system the heat lost in the cooling. Colder streams which are to be heated are employed as the second fluid in such heat exchangers to recover and retain the heat. In such devices the fluids are thermally communicated without physical contact between the two fluid streams exchanging heat.

Any distillation apparatus used in the practice of this invention are understood to imply the full range of such apparatus from simple single-stage equilibrium flash vaporization, through multi-stage stripping (a reboiled distillation without reflux), to complete rectification in a multi-stage fractionator both reboiled and refluxed.

For example, a gasoline stabilizer may be conveniently used as an isenthalpic compressor for useful work production without affecting its original functions. One begins by physically assessing the total capacity of the overhead systems for handling the gross traffic of vapors and thus determining that there exists unused capacity. That quantity if withdrawn from the overhead vapor line of the fractionator as a working fluid. Additional heat may be supplied subject only to availability. The superheated vapor at full stabilizer pressure is expanded in a polytropic engine to state B. The working fluid may then also be used as a refrigerant to the extent limited only by vapor pressure considerations for it is then conveyed directly back to the suction of the charge pump as a recycle stream.

Simultaneously, the net positive suction head requirements of the pumps are considered and a quantity of net gasoline bottoms product withdrawn before transfer to storage for recycle to the suction of the charge pump such that those net positive suction head requirements are satisfied. Thus, when employing a gasoline stabilizer as an isenthalpic compressor, it is within this charge pump that the working fluid proceeds from state B to state C. Achievement of state A proceeds after additional heating within the fractionator in the familiar manner of rectification. There, by heating and partial vaporization of a liquid traffic and cooling and partial condensation of a vapor traffic, recontacting of vapor and liquid is provided in such a manner that, by reorientation of the chemical species present according to their relative volatilites, the quantity and composition of the working fluid, i.e., propane, is restored in the overhead vapor product. Similarly, the quantity and composition of the motive liquid, i.e., gasoline, is restored in the liquid bottoms product.

Having thus described a preferred method for accomplishing isenthalpic compression, it now remains to place this invention in context. Clearly, the ability to compress a fluid isenthalpically from state B to state C has utility in its own right. That is to say, the state A to B and C to A context of a "working fluid" moving through a power cycle is not a necessary condition for the utility of the state B to C isenthalpic compression. For example, the state B to C isenthalpic compression might be independently employed to provide for (1) production of refrigeration, with no concomitant production of shaft work; (2) efficient transmission of electrical power by use of motive and working fluids in the temperature range of superconductivity; (3) the provision of safe, sterile conditions associated with operations at low temperatures; and (4) miniaturization of machinery by realizing the advantages of low temperature operations, that is, taking advantage of the fact that in Equation 1, as $T_2$ approaches zero, the efficiency of the state B to state C step approaches 100 percent, i.e., a nearly complete conversion of heat to work.

When all is said and done, however, the preferred context for isenthalpic compression is a thermodynamic cycle capable of producing useful work, and the most preferred context would be a "closed" thermodynamic dynamic cycle. Such a cycle would comprise:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope;

(2) energizing the working fluid from state B to a state C (representing a pressure $P_3$ approximating $P_1$ and a temperature $T_3$intermediate to temperatures $T_1$ and $T_2$ such that $T_2<T_3<T_1$) which may fall within the vapor-liquid phase envelope by (a) communicating and mixing the working fluid with a large quantity of a motive liquid solvent selected to reduce the two fluids to a single liquid phase, and thereafter (b) pumping the combined liquid phase to pressure $P_3$ and temperature $T_3$ thus achieving state C for the working fluid;

(3) reconstituting the working fluid from the state C back to state A by (a) distilling the resulting fluids from the phase relationship which exists at state C to restore the composition and quantity of the working fluid in the distillation overhead vapor product and the composition and quantity of motive liquid in the distillation bottoms product, and (b) heating the resulting working fluid vapor as necessary to restore it to the temperature and pressure of state A; and (4) reconstituting the motive liquid by cooling and/or deliberately discarding heat from the resulting liquid as necessary to restore it to its initial state;

whereby an approximate isenthalpic compression of the working fluid is incorporated in a closed thermodynamic cycle.

In actual practice, the deliberate discarding of heat can be included for economic and practical reasons. That is, by deliberately discarding heat from the system specific choices of working fluid and motive liquid can be successfully employed at selected states A, B, and C making feasible operations in which fewer stages are required or smaller quantities of motive liquid are needed. In particular, the latitude of choice for advantageous selection of state B is greatly enhanced. Moreover, the use of parasitic power can be sharply diminished leading to great reduction in size of the plant as a whole.

With regard to the subject of heating, it should also be noted that regardless of the method used for achieving the isenthalpic compression from state B to state C, the heating required to drive the working fluid from state C to state A, as well as any heat that may be required to separate motive liquid from working fluid, can be supplied by heat exchange using any convenient source of heat. Ambient sources of surroundings, space, atmosphere, bodies of water, geothermal heat, solar heat, fossil fuel oxidation, nuclear heat and waste heat of nuclear reactors, low temperature level sources otherwise neglected, industrial processes and their effluent waste streams are but a few examples.

Like the A to B portion of the cycle, the C to A portion is also a well know prior art. Implicit in the use of heat exchangers in moving from a point C back to a sub-ambient point A is the fact that a wide range of temperatures for refrigeration (the techniques of which are well known to the art) is made available for selection by the choice of working and motive fluids, and states B and C, in this invention. Air, for example, might be the working fluid which in the course of evaporation in this invention would supply deep (i.e., very low temperature) refrigeration and, as in all sub-ambient cases of this invention, in addition to the shaft work produced. An additional consideration in the C to A step is the controlling of back pressure imposed on the vapor-liquid equilibria (essentially the working fluid) in the distillation restoration of the fluid quantities and composition. Such back pressure will set the upper limit attainable in the energizing step.

Implicit in the concept of the use of different chemical species for the motive liquid and working fluid is the understanding that these two streams may themselves represent chemical mixtures. In fact, the composition of each of the two fluids may include several different chemical species each of which may be incorporated in one or the other or both of the two fluids. The choice of their compositions will depend upon their expediency in the particular service intended for the overall enterprise. Their selection will be readily determined by conventional technical calculations. A typical combination of this type would be ammonia vapor containing minor amounts of water vapor and aqueous ammonia. Other common working fluids, with their critical constants would include, but not be limited to, the following fluids given with their refrigerant number designations where appropriate, as taken from the American Society of Heating, Refrigerating, and Air Conditioning Engineers, Inc., "Thermodynamic Properties of Refrigerants", New York (1969).

| Working Fluid | Refrigerant No. | Critical Temperature Deg. F. | Critical Pressure PSIA |
|---|---|---|---|
| Argon | 740 | −188.12 | 710.4 |
| Oxygen | 732 | −181.08 | 736.8 |
| Air | 729 | −221.31 | 547.4 |
| Nitrogen | 728 | −232.40 | 493.1 |
| Neon | 720 | −379.74 | 384.8 |
| Helium | 704 | −450.31 | 33.2 |
| Para Hydrogen | 702p | −400.31 | 187.5 |
| Normal Hydrogen | 1270 | 197.17 | 670.2 |
| Carbon Dioxide | 744 | 87.87 | 1069.9 |
| Ammonia | 717 | 217.4 | 1647.0 |
| Azeotrope R-12 | 500 | 221.9 | 641.9 |
| Dichlorotetrafluoroethane | 114 | 294.3 | 498.9 |
| Chlorodifluoromethane | 22 | 83.9 | 721.9 |
| Dichlorodifluoromethane | 12 | 233.6 | 597 |
| Trichlorofluoromethane | 11 | 388.4 | 640 |
| Other halogenated hydrocarbons | — | — | — |
| Water | — | 705.4 | 3206.2 |
| Light hydrocarbons | — | — | — |

Helium has particularly attractive thermodynamic, chemical, and non-toxic properties which make it ideal for many applications of the practice of this invention.

DESCRIPTION OF THE PREFERRED EMBODIMENTS

Figure 1:
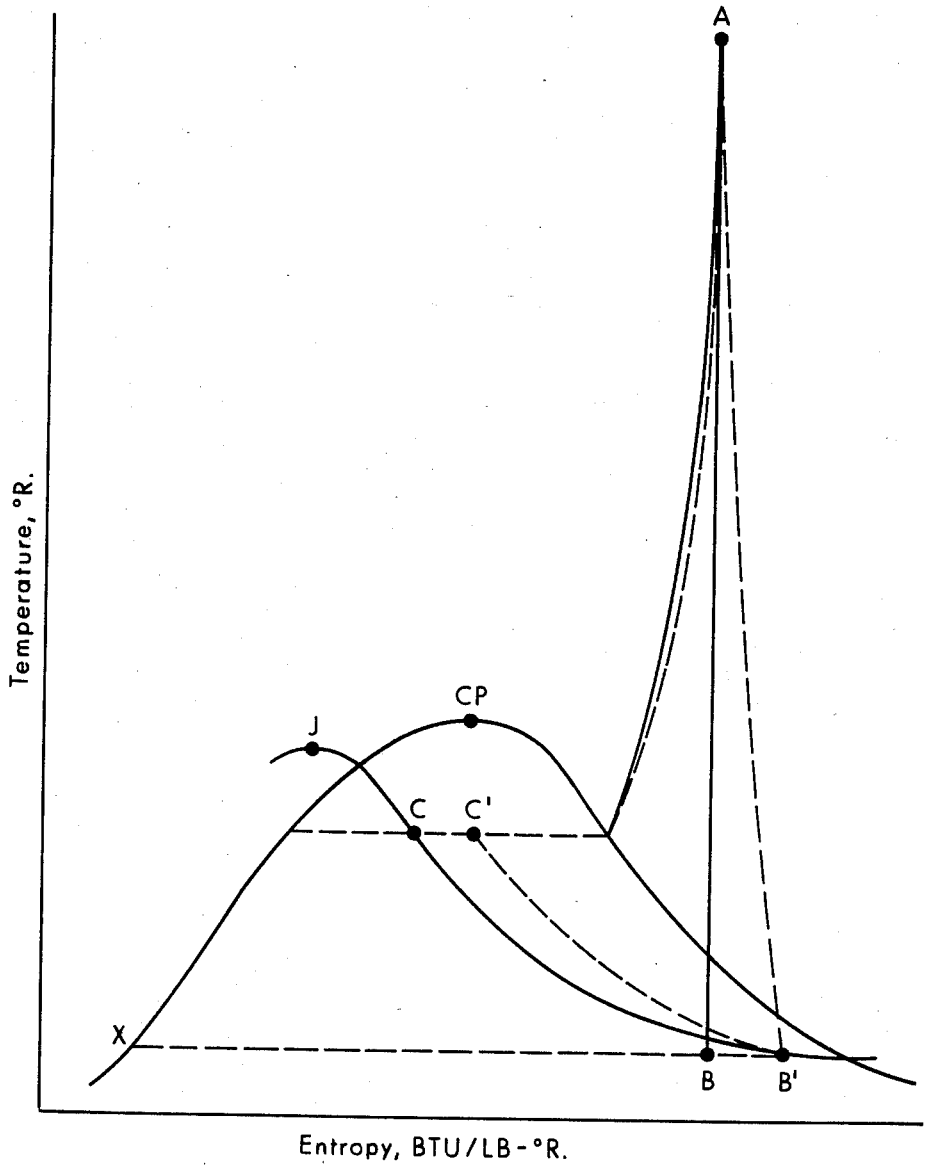
FIG. 1 is a temperature vs. entropy diagram for a typical working fluid and illustrates a typical path of the thermodynamic cycle of the invention.

FIG. 1 is a temperature vs. entropy chart for a typical working fluid used in the practice of this invention. As previously discussed, lines of constant pressure and enthalpy are used to interrelate certain thermodynamic functions which can define a given state of the working fluid. The dome-shaped curve depicts the boundary of the vapor-liquid phase region wherein the liquid and vapor phases may simultaneously co-exist. States A, B, and C are located in exemplary relative positions. State A represents the point of highest pressure $P_1$ and temperature $T_1$. State B represents the point of lowest pressure $P_2$ and temperature $T_2$. State C represents the system nominal high pressure $P_3$ which approximates $P_1$ and an intermediate temperature $T_3$ such that $T_2<T_3<T_1$. Points B', CP, J, C', and X are also located for clarification of certain theoretical points which were discussed in the "Summary of the Invention" section of this patent disclosure. It is along the B' to C constant enthalpy line that the "isenthalpic compression" of this invention is approximated for the reasons discussed at length in said "Summary to the Invention" section. States A, B, and C also serve as important reference points in the ensuing discussion of the representative devices which can produce the isenthalpic compression of this invention.

Figure 2:
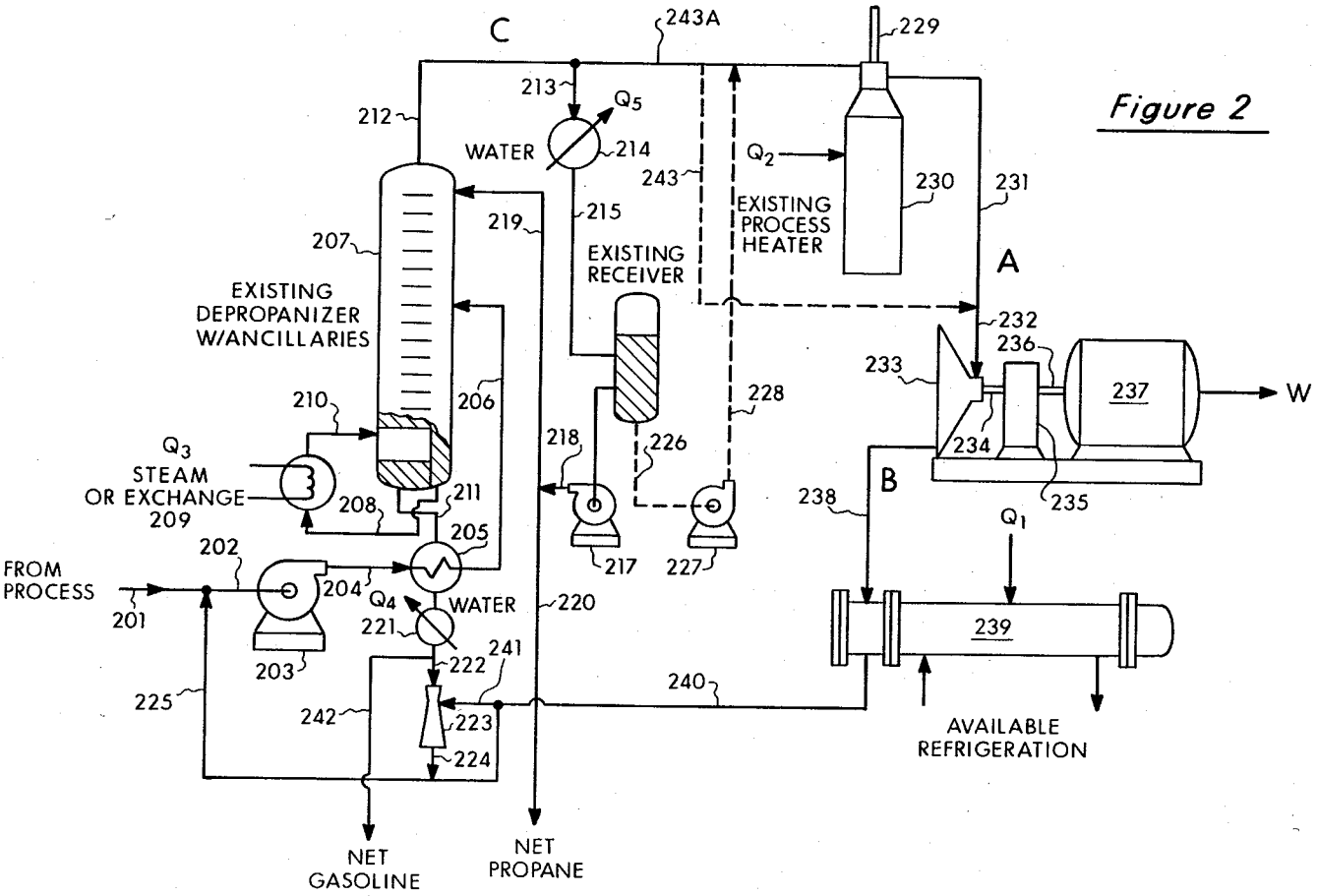
FIG. 2 is a schematic flow diagram of a distillation system wherein a soluble gas and solvent are used to accomplish the state B to state C transition taught by this invention.

FIG. 2, by way of example, depicts the normal operation for the depropanization of gasoline and shows gasoline containing propane entering through conduit 201, due to suction 202 of feed pump 203. The stream is discharged through conduit 204 to heat recovery exchanger 205 and delivered through conduit 206 to the depropanizer distillation column 207. Bottoms liquid of this column are withdrawn via conduit 208 and reboiled in steam or recovery exchanger 209. Net heat $Q_3$ is delivered to the system here. The mixed phase effluent of the reboiler reenters the bottom vapor space of column 207 through conduit 210 and a liquid portion is withdrawn from the bottom collecting space through conduit 211 to deliver surplus heat to recovery exchanger 205.

Total overhead vapor of column 207 leaves through conduit 212 and via inlet 213 of water cooler-condenser 214 is delivered via conduit 215, fully condensed, to overhead receiver 216. In the water cooler-condenser heat $Q_5$ is removed from the system. Total liquid overhead product is withdrawn from receiver 216 by a product/reflux pump 217 and via discharge 218 is returned to the overhead of column 207 via conduit 219 as reflux or via conduit 220 the net propane product is sent to storage facilities not shown.

Bottoms product net gasoline is received from the effluent of heat recovery exchanger 205 and cooled in water sub-cooler 221 in which heat $Q_4$ is removed from the system, and via conduit 242 the net gasoline product is sent to storage not shown.

In the practice of this invention, net portions of the overhead product are temporarily diverted from conduit 212 via conduit 243 to the suction of the expansion turbine 232 or expansion engine device not shown. Should additional waste heat be elsewhere available, the portion of overhead product withdrawn via conduit **243*a* can be instead diverted to a waste heat recovery unit depicted in FIG. 2 as coil 229 placed in a plenum chamber of an existing process heater 230 to recover waste convection heat and/or additional fired heat capacity currently not being utilized. At this point additional heat $Q_2$ is introduced to the system. The superheated vapor leaving the plenum chamber via conduit 231 will then be supplied to suction 232 of the expansion device 233**.

The employment potentiality of such waste heat can be further enhanced as follows. The total overhead product of column 207 is, as originally, received via conduit 215 in receiver 216. In whatever amounts desirable in accordance with the excess heat available, liquid is then withdrawn in a side recycle stream via conduit 226 to be utimately reincorporated as increased flow through the depropanizer. As before, the identical amount of overhead vapor product continues to be available to be withdrawn for refluxing and to permit the net production of propane to be delivered to storage. In the course of the recycle, however, booster pump 227 receives, through conduit 226 and delivers through conduit 228, a portion of recycle propane. This is returned to the inlet of the waste heat recovery facility 230 and as before, via conduits 231 and 232, enters the expansion device 233.

The expansion device is rotated by the working fluid to perform such typical operations as the rotation of shaft 234 which can in turn run reduction gear 235, shaft 236 and generating device 237 to yield the gross work output W of this cycle. The effluent of expansion device 233 is delivered via conduit 238 to heat exchange means 239 which is a low level opportunity source of ambient heat, but, more particularly, deriving special and valuable benefit by provision of substantially subambient temperatures. In the course of such refrigeration, heat $Q_1$ is added to the system. The recylce volume of working fluid in the vapor phase is then delivered via conduit 240 and thence conduit 225 to the suction 202 of the main feed pump 203 or, in general, to the dissolution system for isenthalpic compression 223.

A still further modification is available for increased circulation capacity of the working fluid: that of increasing the circulation of gasoline. The equipment capacities permitting, quantities of product gasoline can be diverted at the outlet of the water cooler 221 temporarily since they will, via recycle, eventually reappear in the gross flow at this point. Thus, the identical gasoline production will still be available via conduit 242 to go to storage. The diverted gasoline, being under the depropanizer working pressure less small frictional losses, will be presented as motive liquid at the inlet nozzle of jet mixer 223. Vapor working fluid in conduit 240 rather than following conduit 225 will be diverted via suction 241 of mixer 223 and the combined streams fed via discharge 224 to conduit 225 for recycling.

This example is given by way of illustration and should not be considered as a limitation on the broader teachings of this invention. Many other obvious modifications could be made by those skilled in the art. At the very least, the principles of pumping incompressible liquids and reducing, insofar as possible without heat loss, the temperature rise in the compression of compressible fluids, and the use of motive liquids of chemical species other than the working fluid are all encompassed in the goal of isenthalpic compression, that is to say irreversible adiabatic compression, without departing from the spirit of this invention and the scope of the appended claims.

What is claimed is:

1. A process for approximating an isenthalpic compression of a working fluid from a state B (representing a pressure $P_2$ lower than a pressure $P_1$ of a state A and a temperature $T_2$ lower than a temperature $T_1$ of state A) to a state C (representing a pressure $P_3$ approximating $P_1$ and a temperature $T_3$ intermediate to temperatures $T_1$ and $T_2$ such that $T_2<T_3<T_1$) comprising:

pressure energizing the working fluid in state B by, (a) communicating and mixing the working fluid with a large quantity of a motive liquid solvent selected to reduce the two fluids to a single liquid phase, and thereafter (b) pumping the combined liquid phase to pressure $P_3$ and temperature $T_3$ thus achieving state C for the working fluid.

2. The process of claim 1 which additionally comprises the step of deliberately discarding heat from at least one of the two fluids whereby selection of states A, B, and C for the two fluids is made possible for prescribed chemical species.

3. The process of claim 1 wherein the large quantity of motive liquid is provided by adjustment of the rate of recycling of a fixed motive liquid inventory.

4. The process of claim 1 wherein the large quantity of motive liquid is provided by an external source.

5. The process of claim 1 wherein the large quantity of motive liquid is provided by incorporating a recycle of the motive liquid inventory with motive liquid drawn from an external source.

6. The process of claim 1 wherein the large quantity of motive liquid is maintained by condensation of working fluid.

7. The process of claim 1 wherein the energizing of the working fluid is accomplished by pumping combined motive liquid and working fluid as a single liquid phase.

8. The process of claim 1 wherein the communication and mixing of the working fluid and motive liquid is accomplished by eduction of the working fluid into the motive liquid.

9. The process of claim 1 wherein the communication and mixing of the working fluid and motive liquid is accomplished by pressing a jet water heater into the role of a jet eductor so that said water heater educts the working fluid into the motive liquid.

10. The process of claim 1 wherein the communication and mixing of the working fluid with the motive liquid is accomplished by absorbing the working fluid, as a solute, into a motive liquid solvent.

11. The process of claim 1 wherein the communication and mixing of the working fluid with the motive liquid is accomplished by direct introduction and dissolution of working fluid, as a solute, into a solvent motive liquid.

12. A thermodynamic cycle process comprising:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid by (a) communicating and mixing the working fluid with a large quantity of a motive liquid solvent selected to reduce the two fluids to a single liquid phase, and thereafter (b) pumping the combined liquid phase to pressure $P_3$ and temperature $T_3$ thus achieving state C for the working fluid;

(3) reconstituting the working fluid from the state C back to state A by (a) distilling the resulting fluids from the phase relationship which exists at state C to restore the composition and quantity of the working fluid in the distillation overhead vapor product and the composition and quantity of motive liquid in the distillation bottoms product, and (b) heating the resulting working fluid vapor as necessary to restore it to the temperature and pressure of state A; and (4) reconstituting the motive liquid by cooling and/or deliberately discarding heat from the resulting liquid as necessary to restore it to its initial state;

whereby an approximate isenthalpic compression of the working fluid is incorporated in a thermodynamic cycle.

13. The thermodynamic cycle process of claim 12 wherein the large quantity of motive liquid is provided by adjustment of the rate of recycling of a fixed motive liquid inventory.

14. The thermodynamic cycle process of claim 12 wherein the large quantity of motive liquid is provided by incorporating a recycle of a motive liquid inventory with motive liquid from an external source.

15. The thermodynamic cycle process of claim 12 wherein the large quantity of motive liquid is provided by maintaining its constant inventory through excessive condensation of working fluid.

16. The thermodynamic cycle process of claim 12 wherein the energizing of the working fluid is accomplished by pumping combined motive liquid and working fluid as a single liquid phase.

17. The thermodynamic cycle process of claim 12 wherein the communication and the mixing of the working fluid and the motive liquid is accomplished by eduction of the working fluid into the motive liquid.

18. The themodynamic cycle process of claim 12 wherein the communication and the mixing of the working fluid and the motive liquid is accomplished by pressing a jet water heater into the role of a jet eductor so that said water heater educts the working fluid into the motive liquid.

19. The thermodynamic cycle process of claim 12 wherein the communication and mixing of the working fluid with the motive liquid is accomplished by absorbing the working fluid, as a solute, into a motive liquid solvent.

20. The thermodynamic cycle process of claim 12 wherein the communication and mixing of the working fluid with the motive liquid is accomplished by direct introduction and dissolution of working fluid as a solute into the motive liquid as a solvent.

21. The thermodynamic cycle process of claim 12 wherein reconstitution of the composition and quantity of the working fluid and the motive liquid is accomplished by multiple stages of chemical vaporliquid equilibria.

22. The thermodynamic cycle process of claim 12 wherein the heating of the resulting vapor is by use of ambient heat.

23. The thermodynamic cycle process of claim 12 wherein the heating of the resulting vapor is by use of an industrial waste heat source.

24. The thermodynamic cycle process of claim 12 wherein a portion of the heating of the combined fluids and the cooling of the resulting motive liquid quantity takes place by interchange of heat in a device known as a heat exchanger.

25. The thermodynamic cycle process of claim 12 wherein the working fluid and the motive liquid are of different chemical species, the combination of which produces vapor-liquid phase envelopes whose characteristics vary according to the relative proportions of the different chemical species.

26. The thermodynamic cycle process of claim 12 wherein the working fluid is a mixture and the motive liquid is a different mixture.

27. The thermodynamic cycle process of claim 12 wherein the working fluid is ammonia and the motive liquid is water with ammonia dissolved in it.

28. The thermodynamic cycle process of claim 12 which additionally comprises controlling the back pressure of the working fluid after it reaches state C.

29. The thermodynamic cycle process of claim 12 which additionally comprises performing a Joule-Thompson expansion of the working fluid and/or the motive liquid in order to provide for additional cooling as required.

30. A thermodynamic cycle process comprising:

(1) expanding a refrigerant working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the refrigerant working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, by (a) communicating and mixing the working fluid with a large quantity of a motive liquid solvent selected to reduce the two fluids to a single liquid phase, and thereafter (b) pumping the combined liquid phase to pressure $P_3$ and temperature $T_3$ thus achieving state C for the working fluid;

(3) reconstituting the refrigerant working fluid from the state C back to state A, by (a) distilling the resulting fluids from the phase relationship which exists at state C under sufficient back pressure to restore the composition and quantity of the working fluid in the distillation overhead vapor product and the composition and quantity of motive liquid in the distillation bottoms product, and (b) heating the resulting refrigerant working fluid vapor using low temperature level and/or ambient sources as necessary to restore it to the temperature and pressure of state A; and (4) reconstituting the motive liquid by cooling and/or deliberately discarding heat from the resulting liquid as necessary to restore it to its initial state;

whereby an approximate isenthalpic compression of the refrigerant working fluid is incorporated in a closed thermodynamic cycle having state A at ambient conditions.

31. The thermodynamic cycle process of claim 30 wherein the working fluid is a halogenated hydrocarbon refrigerant.

32. The thermodynamic cycle process of claim 30 wherein the working fluid is liquid nitrogen.

33. The thermodynamic cycle process of claim 30 wherein the working fluid is ammonia.

34. The thermodynamic cycle process of claim 30 wherein the cycle additionally comprises effecting a Joule-Thompson expansion of at least one of the two fluids.

35. The thermodynamic cycle process of claim 30 wherein the heating of the resulting vapor is accompanied by recovery of refrigeration.

36. The thermodynamic cycle process of claim 30 wherein the recovery of refrigeration is accompanied by evaporation of a fluid.

37. The thermodynamic cycle process of claim 30 wherein the working fluid is air.

38. The thermodynamic cycle process of claim 30 wherein the working fluid vapor is propane and the solvent motive liquid is gasoline.

39. A thermodynamic cycle process comprising:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, by (a) communicating and mixing the working fluid with a large quantity of a motive liquid solvent selected to reduce the two fluids to a single liquid phase, and thereafter (b) pumping the combined liquid phase to pressure $P_3$ and temperature $T_3$ thus achieving state C for the working fluid;

(3) reconstituting the working fluid from the state C back to state A by (a) heating the combined fluids, (b) introducing the combined fluids, in any two phase proportions resulting from the heating, into a device known as a multi-stage fractionator (or rectifier) in which, by heating and partial vaporization of a liquid traffic and cooling and partial condensation of a vapor traffic, a recontacting of vapor and liquid is provided in the several stages of the fractionator in such a manner that, by re-orientation of the chemical species present according to their relative volatilities, the composition and quantity of working fluids is restored in the overhead vapor product of the fractionation and the composition and quantity of motive liquid is restored in the rectification bottoms liquid product, and (c) heating the resulting working fluid vapor as necessary to restore it to the temperature and pressure of state A; and (4) reconstituting the motive liquid by cooling and/or deliberately discarding heat from the resulting liquid as necessary to restore it to its initial state;

whereby an approximate isenthalpic compression of the working fluid is incorporated in a thermodynamic cycle, closed by having restored working fluid and motive liquid of different compositions to their original conditions, having reconstituted the temperature, pressure, composition and quantity of each fluid.

40. A thermodynamic cycle process comprising:

(1) expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, by (a) communicating and mixing the working fluid in a device known as a multi-stage absorber with a large quantity of a motive liquid solvent selected to reduce the two fluids to a single liquid phase, and thereafter (b) pumping the combined liquid phase to pressure $P_3$ and temperature $T_3$ thus achieving state C for the working fluid;

(3) reconstituting the working fluid from the state C back to state A, by (a) heating the combined fluids, (b) distilling by flashing the combined fluids under conditions known as single stage equilibrium flash vaporization, in the two phase proportions resulting from the heating, such that, by orientation of the chemical species present according to their relative volatilities, the composition and quantity of working fluids is restored in the overhead vapor product of the distillation and the composition and quantity of motive liquid is restored in the distillation bottoms liquid product, and (c) heating the resulting working fluid vapor as necessary to restore it to the temperature and pressure of state A; and (4) reconstituting the motive liquid by cooling and/or deliberately discarding heat from the resulting liquid as necessary to restore it to its initial state;

whereby an approximate isenthalpic compression of the working fluid is incorporated in a thermodynamic cycle, closed by having restored working fluid and motive liquid of different composition to their original conditions by having reconstituted the temperature, pressure, composition and quantity of each fluid.

41. The thermodynamic cycle process of claim 40 wherein the working fluid is ammonia vapor containg minor amounts of water vapor and the motive liquid is aqueous ammonia.

42. An apparatus for approximating an isenthalpic compression of a working fluid from a state B (representing a pressure $P_2$ lower than a pressure $P_1$ of a state A and a temperature $T_2$ lower than a temperature $T_1$ of state A) to a state C (representing a pressure $P_3$ approximating $P_1$ and a temperature $T_3$ intermediate to temperatures $T_1$ and $T_2$ such that $T_2<T_3<T_1$) comprising:

means for pressure energizing the working fluid in state B through (a) means for communicating and mixing the working fluid with a large quantity of a motive liquid solvent selected to reduce the two fluids to a single liquid phase, and (b) means for pumping the combined liquid phase to pressure $P_3$ and temperature $T_3$ thus achieving state C for the working fluid in an apparatus approximating isenthalpic compression.

43. The apparatus of claim 42 which additionally comprises means for deliberately discarding heat from at least one of the two fluids whereby selection of states A, B, and C is made possible for prescribed chemical species.

44. The apparatus of claim 42 wherein the large quantity of motive liquid is provided by a fixed motive liquid inventory recycled at adjusted rates.

45. The apparatus of claim 42 wherein the large quantity of motive liquid is maintained by means for condensing a surplus of working fluid.

46. The apparatus of claim 42 wherein the means for energizing the working fluid is a pump capable of pumping the combined fluids as a single liquid phase.

47. The apparatus of claim 42 wherein the means for communicating and mixing the motive liquid and the working fluid is a jet eductor.

48. The apparatus of claim 42 wherein the means for communicating and mixing the motive liquid and the working fluid is a water heater pressed into the role of a jet eductor so that the water heater educts the working fluid into the motive liquid.

49. The apparatus of claim 42 wherein the means for communicating and mixing the working fluid with the motive liquid is a means for absorbing the working fluid, as a solute, into a motive liquid solvent.

50. The apparatus of claim 42 wherein the means for communicating and mixing the motive liquid with the working fluid is a means for direct introduction and dissolution of working fluid as a solute into a solvent motive liquid.

51. A thermodynamic cycle apparatus comprising:

(1) turbine means for expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, through (a) means for communicating and mixing the working fluid with a large quantity of a motive liquid solvent selected to reduce the two fluids to a single liquid phase, and (b) means for pumping the combined liquid phase to pressure $P_3$ and temperature $T_3$ thus achieving state C for the working fluid;

(3) means for reconstituting the working fluid from the state C back to state A, by means for (a) distilling the resulting fluids from the phase relationship which exists at state C to restore the composition and quantity of the working fluid in the distillation overhead vapor product and the composition and quantity of motive liquid in the distillation bottoms product, and (b) heating the resulting working fluid vapor as necessary to restore it to the temperature and pressure of state A; and (4) means for reconstituting the motive liquid by cooling and/or deliberately discarding heat from the resulting liquid as necessary to restore it to its initial state;

whereby an apparatus is provided to render an approximate isenthalpic compression of the working fluid in a closed thermodynamic cycle.

52. The thermodynamic cycle apparatus of claim 51 which additionally comprises means for cooling the motive liquid to achieve its initial state.

53. The thermodynamic cycle apparatus of claim 51 wherein the large quantity of motive liquid is provided by means for adjusting the rate of recycle of a fixed motive liquid inventory.

54. The thermodynamic cycle apparatus of claim 51 wherein the large quantity of motive liquid is provided by means for incorporating a recycle of the motive liquid inventory with motive liquid from an external source.

55. The thermodynamic cycle apparatus of claim 51 wherein the large quantity of motive liquid is provided by means for maintaining its constant inventory through condensation of surplus working fluid.

56. The thermodynamic cycle apparatus of claim 51 wherein the energizing is accomplished by means for pumping combined motive and working fluid as a single liquid phase.

57. The thermodynamic cycle apparatus of claim 51 wherein the means for communicating and mixing the motive liquid and the working fluid is a jet eductor.

58. The thermodynamic cycle apparatus of claim 51 wherein the means for communicating and mixing the motive liquid and the working fluid is a jet water heater pressed into the role of a jet eductor so that said jet water heater educts the working fluid into the motive liquid.

59. The thermodynamic cycle apparatus of claim 51 wherein the means for communicating and mixing the working fluid with the motive liquid is a means for absorbing the working fluid, as a solute, into a motive liquid solvent.

60. The thermodynamic cycle apparatus of claim 51 wherein the means for communicating and mixing the working fluid with the motive liquid is a means for direct introduction and dissolution of the working fluid as a solute, into the motive liquid as a solvent.

61. The thermodynamic cycle apparatus of claim 51 wherein the reconstitution of the working fluid is accomplished by means for separating liquid and vapor phases, and means for thereafter maintaining a constant liquid inventory as reconstituted motive liquid, recovering working fluid as surplus liquid and total vapor and thereafter heating as required to reconstitute the working fluid in state A.

62. The thermodynamic cycle apparatus of claim 51 wherein the reconstitution of the working fluid and motive liquid is accomplished by means for introducing the combined fluids of state C to chemical vapor-liquid equilibrium, and means in which, by heating and recontacting liquid and vapor phases, the chemical species and quantity of the working fluid is reconstituted as a vapor product, whereupon additional heat is applied as required to the working fluid vapor to restore it to state A and whereupon a means for cooling the motive liquid is provided to restore said motive liquid to its initial state.

63. The thermodynamic cycle apparatus of claim 51 wherein the means for reconstitution of the composition and quantity of the working fluid and the motive liquid is a multiple stage vapor-liquid equilibria means.

64. The thermodynamic cycle apparatus of claim 51 wherein the means for heating the resulting working fluid vapor is a heat exchanger using ambient heat.

65. The thermodynamic cycle apparatus of claim 51 wherein the means for heating the resulting working fluid vapor is a heat exchanger using an industrial waste heat source.

66. The thermodynamic cycle apparatus of claim 51 which additionally comprises a back pressure control device for controlling the back pressure of the working fluid after it reaches state C.

67. The thermodynamic cycle apparatus of claim 51 which additionally comprises a Joule-Thompson expansion means for sub-cooling at least one of the two fluids.

68. A thermodynamic cycle apparatus comprising:

(1) turbine means for expanding a refrigerant working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the refrigerant working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, through (a) means for communicating and mixing the working fluid with a large quantity of a motive liquid solvent selected to reduce the two fluids to a single liquid phase, and (b) means for pumping the combined liquid phase to pressure $P_3$ and temperature $T_3$ thus achieving state C for the working fluid;

(3) means for reconstituting the refrigerant working fluid from the state C back to state A, through (a) means for distilling the resulting fluids from the phase relationship which exists at state C under sufficient back pressure to restore the composition and quantity of the working fluid in the distillation overhead vapor product and the composition and quantity of motive liquid in the distillation bottoms product, and (b) means for heating the resulting refrigerant working fluid vapor using low temperature level and/or ambient sources as necessary to restore it to the temperature and pressure of state A; and (4) means for reconstituting the motive liquid by cooling and/or deliberately discarding heat from the resulting liquid as necessary to restore it to its initial state;

whereby an approximate isenthalpic compression of the refrigerant working fluid is incorporated in a closed thermodynamic cycle having state A at ambient conditions.

69. The thermodynamic cycle apparatus of claim 68 which additionally comprises means for effecting a Joule-Thompson of at least one of the two fluids in order to provide a sub-cooled liquid.

70. The thermodynamic cycle apparatus of claim 68 which additionally comprises means for recovering refrigeration.

71. A thermodynamic cycle apparatus comprising:

(1) turbine means for expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, through (a) means for communicating and mixing the working fluid with a large quantity of a motive liquid solvent by direct introduction and dissolution of the working fluid into the motive liquid to form a single liquid phase, and (b) means for pumping the combined liquid phase to pressure $P_3$ and temperature $T_3$ thus achieving state C for the working fluid;

(3) means for reconstituting the working fluid from the state C back to state A, through means for (a) heating the combined fluids;

(b) introducing the combined fluids, in any two phase proportions resulting from the heating, into a device known as a multi-stage fractionator (or rectifier) in which, by heating and partial vaporization of a liquid traffic and cooling and partial condensation of a vapor traffic, a recontacting of vapor and liquid is provided in the several stages of the fractionator in such a manner that, by re-orientation of the chemical species present according to their relative volatilities, the composition and quantity of working fluids is restored in the overhead vapor product of the fractionation and the composition and quantity of motive liquid is restored in the rectification bottoms liquid product; and (c) heating the resulting working fluid vapor as necessary to restore it to the temperature and pressure of state A; and (4) means for reconstituting the motive liquid by cooling and/or deliberately discarding heat from the resulting liquid as necessary to restore it to its initial state;

whereby an approximate isenthalpic compression of the working fluid is incorporated in a thermodynamic cycle, closed by having restored working fluid and motive liquid of different composition to their original conditions by having reconstituted the temperature, pressure, composition and quantity of each fluid.

72. The thermodynamic cycle apparatus of claim 71 wherein the reconstitution of the chemical species and quantities of the working fluid and the motive liquid is by stripper means with reboiling as necessary.

73. The thermodynamic cycle apparatus of claim 71 wherein the reconstitution of the working fluid and the motive liquid in chemical species and quantities is by means for single stage equilibrium flash vaporization.

74. The thermodynamic cycle apparatus of claim 71 wherein the communication and mixing of the working fluid vapor with the higher boiling, lower volatility solvent is accomplished by means for the introduction of the motive liquid and the working fluid vapor to an absorber, thus producing a single liquid phase of the combined fluids.

75. The thermodynamic cycle apparatus of claim 71 wherein the motive liquid introduced into the absorber is gasoline and the working fluid is propane.

76. A thermodynamic cycle apparatus comprising:

(1) turbine means for expanding a working fluid from a state A (representing a pressure $P_1$ and a temperature $T_1$ outside a vapor-liquid phase envelope for the working fluid) to a state B (representing a pressure $P_2$ lower than $P_1$ and a temperature $T_2$ lower than $T_1$) which may fall inside the vapor-liquid phase envelope for the working fluid;

(2) means for energizing the working fluid from state B to state C (representing a pressure $P_3$ approximating $P_1$ and a temperature $T_3$ intermediate to temperatures $T_1$ and $T_2$ such that $T_2<T_3<T_1$) which may fall within the vapor-liquid phase envelope for the working fluid, through (a) absorber means for communicating and mixing the working fluid with a large quantity of a motive liquid solvent to form a single liquid phase, and (b) means for pumping the combined liquid phase to pressure $P_3$ and temperature $T_3$ thus achieving state C for the working fluid;

(3) means for reconstituting the working fluid from the state C back to state A, through (a) heating the combined fluids by use of heat exchange;

(b) introducing the combined fluids, in any two phase proportions resulting fom the heating, into a device to perform a single stage equilibrium flash vaporization; and (c) heating the resulting working fluid vapor by heat exchange with waste exhaust steam as necessary to restore it to the temperature and pressure of state A; and (4) means for reconstituting the motive liquid by heat exchange with energized cold combined liquid at state C and deliberately discarding further heat from the resulting cooled motive liquid as necessary to restore it to its initial state;

whereby an approximate isenthalpic compression of the working fluid is incorporated in a thermodynamic cycle, closed by having restored working fluid and motive liquid of different composition to their original conditions by having reconstituted the temperature, pressure, composition and quantity of each fluid.

* * * * *